US007749426B2

(12) United States Patent
Koda et al.

(10) Patent No.: US 7,749,426 B2
(45) Date of Patent: Jul. 6, 2010

(54) METHOD FOR CONTROLLING MOLTEN METAL MATERIAL LEAKING IN INJECTION APPARATUS OF METAL MOLDING APPARATUS

(75) Inventors: Toshiyasu Koda, Nagano-ken (JP); Mamoru Miyagawa, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 61 days.

(21) Appl. No.: 12/012,646

(22) Filed: Feb. 5, 2008

(65) Prior Publication Data

US 2008/0203628 A1 Aug. 28, 2008

(30) Foreign Application Priority Data

Feb. 6, 2007 (JP) ..... 2007-026940

(51) Int. Cl.

| | |
|---|---|
| ***C21B 7/12*** | (2006.01) |
| *C22B 21/00* | (2006.01) |
| *B22D 39/00* | (2006.01) |
| *B22D 45/00* | (2006.01) |
| *B22D 41/00* | (2006.01) |
| *B22D 37/00* | (2006.01) |

(52) U.S. Cl. ..... 266/45; 266/200; 222/590

(58) Field of Classification Search ..... 266/200, 266/45; 222/590

See application file for complete search history.

(56) References Cited

U.S. PATENT DOCUMENTS 4,284,124 A * 8/1981 Komatsu et al. ..... 164/314
2005/0056978 A1* 3/2005 Fujikawa ..... 266/200

FOREIGN PATENT DOCUMENTS

JP 2004 291032 10/2004
WO WO 2004/018130 A1 3/2004

* cited by examiner

*Primary Examiner*—Roy King
*Assistant Examiner*—Alexander Polyansky
(74) *Attorney, Agent, or Firm*—Weingarten, Schurgin, Gagnebin & Lebovici LLP

(57) ABSTRACT

A method for controlling a molten metal material in an injection apparatus that includes a cylinder body with a nozzle at a front end, and a discharge opening on a bottom side of a rear portion. Heating means are provided on an outer periphery of the cylinder body and an injection cylinder is inserted onto an injection plunger for a forward and backward travel within a clearance inside the cylinder body. A material melting and supplying apparatus on a top portion of the injection cylinder has a bottom end outlet communicating with a cylinder body supply opening. Molten metal material accumulates from the supply opening in a cylinder front portion by backward plunge travel and is injected by a forward plunge travel. Heating means maintains the temperature of the molten metal material in front and middle cylinder portions and allows a lower temperature in a rear portion providing a seal metal as well as a lubricant.

12 Claims, 4 Drawing Sheets

METHOD FOR CONTROLLING MOLTEN METAL MATERIAL LEAKING IN INJECTION APPARATUS OF METAL MOLDING APPARATUS

This application claims priority to Japanese application No. 2007-26940 filed Feb. 6, 2007.

BACKGROUND OF THE INVENTION

1. Field of the Invention

The present invention relates to a method for controlling a molten metal material leaking in an injection apparatus of a metal molding apparatus for a low-melting-point metal material such as magnesium and aluminum.

2. Description of the Prior Art

In an injection apparatus for a low-melting-point metal material, there is provided a slide clearance for an injection plunger between an inner peripheral surface of an injection cylinder and an outer peripheral surface of the injection plunger. Molten metal in a cylinder front portion, which is pressurized by the injection plunger traveling forward during the injection, leaks to this slide clearance. If this leaked material remains at a cylinder rear portion having a temperature lower than that of the cylinder front portion, this leaked material solidifies hard, and constitutes a slide resistance for the injection plunger, thereby adversely influencing the travel of the injection plunger, and a discharge opening for the leaked material is thus provided on the injection cylinder to discharge the leaked material from the slide clearance.

However, there is a low-melting-point metal material such as a magnesium base alloy which ignites if discharged in the atmosphere in a heated state, and there is thus known a molten metal molding apparatus which is provided with a drain storage apparatus with an airtight structure at a discharge opening as means to prevent this, and forms an inert gas atmosphere in the drain storage apparatus to store the metal drain (refer to Japanese Laid-Open Patent Publication No. 2004-291032).

Moreover, there is an injection apparatus which has a circular groove formed at a rear end of an injection cylinder, and solidifies melt, which has flown back in the circular groove, in a somehow soften state by a coolant and a high heat from a heated injection plunger to form a seal member, thereby preventing the backflow (refer to WO2004/018130).

In the process by the drain storage apparatus, a space for the installation is required on the bottom side of the injection cylinder, and since the injection apparatus is usually mounted for forward and backward travel on a machine base, the injection apparatus should be specifically configured so that the drain storage apparatus, which is always connected to an inert gas cylinder, can travel together. Moreover, the leaked material in the slide clearance is directly discharged and recovered, so there is a problem that the material should be measured in consideration of an injection loss by the drain.

Moreover, the molten metal, which has flown back, is solidified in the circular groove in the rear end of the injection cylinder to seal the slide clearance, it is necessary to form a cylinder rear end as a protrusion with a small diameter, to provide the circular groove therein, and to provide a cooling pipe for circulating the coolant in the protrusion with the small diameter, and the structure of the rear end of the injection cylinder thus becomes complicated compared with a conventional injection cylinder. Moreover, since the seal member should be solidified into the somehow soft state by the high heat from both the coolant and the injection plunger, there is also a problem that temperature control relating to the formation of the seal member is difficult.

SUMMARY OF THE INVENTION

The present invention is devised in view of the above problem relating to the conventional leaked material, and has an object to provide a novel method for controlling a molten metal material leaking in an injection apparatus of a metal molding apparatus which can restrict a leak of a metal material in a fully molten state or partially molten state (referred to as molten metal material hereinafter) to a slide clearance by temperature control of heating means attached to a cylinder body without especially changing a structure of an injection cylinder.

In order to achieve the above object, the present invention provides a method for controlling a molten metal material leaking in an injection apparatus for molding a metal material; the injection apparatus comprising: an injection cylinder comprising: a cylinder body including a nozzle at a front end of the cylinder body, a discharge opening on a bottom side of a rear portion of the cylinder body, a heating means on an outer periphery of the cylinder body, and an injection plunger inserted into the cylinder body for a forward and backward travel by providing a slide clearance inside of the cylinder body; and a melting and supplying apparatus for a metal material provided on a top portion of the injection cylinder, and having a flow outlet at a bottom end of the melting and supplying apparatus communicating with a supply opening of the cylinder body; wherein the molten metal material is accumulated from the supply opening in a front portion of the cylinder body by a backward travel of the injection plunger, and is injected from the nozzle by a forward travel of the injection plunger; wherein the heating means is provided to control the temperature in three zones of a front portion, a middle portion, and a rear portion from the front end to the discharge opening of the cylinder body, the front portion and the middle portion are set to a temperature for maintaining the temperature of the molten metal material supplied from the supply opening into the cylinder body, and the rear portion is set to such a temperature that the temperature of the molten metal material leaking to the slide clearance is lower than the temperature of the supplied molten metal material, and thus the leaked molten metal material is interposed as a seal metal as hard as functioning as a lubrication layer for a plunger rear portion.

Moreover, the metal material includes a magnesium base alloy, and the temperature of the rear portion of the cylinder body is set to 470 to 490° C. thus causing the molten metal material leaking to the slide clearance to be a seal metal as hard as functioning as the lubrication layer, and the seal metal interposing in the slide clearance is sequentially discharged from a clearance end to the discharge opening as the injection plunger travels backward.

Moreover, the material melting and supplying apparatus is always in a communication state with the inside of the cylinder body via the supply opening and the flow outlet, thereby leading the molten metal material, which is pressurized by the forward travel of the injection plunger, and thus flows back from the clearance of a plunge head, into the material melting and supplying apparatus, resulting in reducing the leak of the molten metal material into the slide clearance in a plunger rod rear portion.

Moreover, the inside of the cylinder body is formed by a cylinder liner, and the cylinder liner and the injection plunger are made of a metal material of the same quality, and the cylinder body is made of an iron base metal material, and the cylinder liner and the injection plunger are made of a metal material of the same quality which is a cobalt base alloy or a cermet base alloy.

EFFECTS OF THE INVENTION

According to the present embodiment, since it is possible to restrict the leak of the molten metal material into the slide clearance by simply setting the rear portion of the cylinder body to the solidifying temperature at which the molten metal material which has leaked to the slide clearance is interposed as a seal metal as hard as functioning as a lubricant layer at the plunger rod rear portion, application to an injection apparatus with an ordinary specifications is possible.

Moreover, since the seal metal functions as the lubricant layer for the plunger rod, even if the slide clearance is fully filled with the solidified metal material, it does not constitute a slide resistance which works against the forward and backward travel of the injection plunger, and the support of the plunger rod rear portion by the seal metal causes the smooth forward and backward travel of the injection plunger.

Moreover, since the inside of the cylinder body and the inside of the material melting and supplying apparatus always communicate with each other, and the molten metal material flowing back from the plunger head side due to the forward travel of the injection plunger is lead to the inside of the material melting and supplying apparatus, the leak to the slide clearance due to the pressure increase at the periphery of the plunger rod front portion is prevented, and the leak of the molten metal material to the slide clearance is always restricted to the discharged amount of the seal metal, the seal metal interposed in an excessively concentrated state will not press the plunger rod rear portion, the smooth forward and backward travel of the injection plunger is maintained even in an operation for a long period, and the injection loss of the molten metal material due to the leak is reduced.

DESCRIPTION OF THE PREFERRED EMBODIMENT

Figure 1:
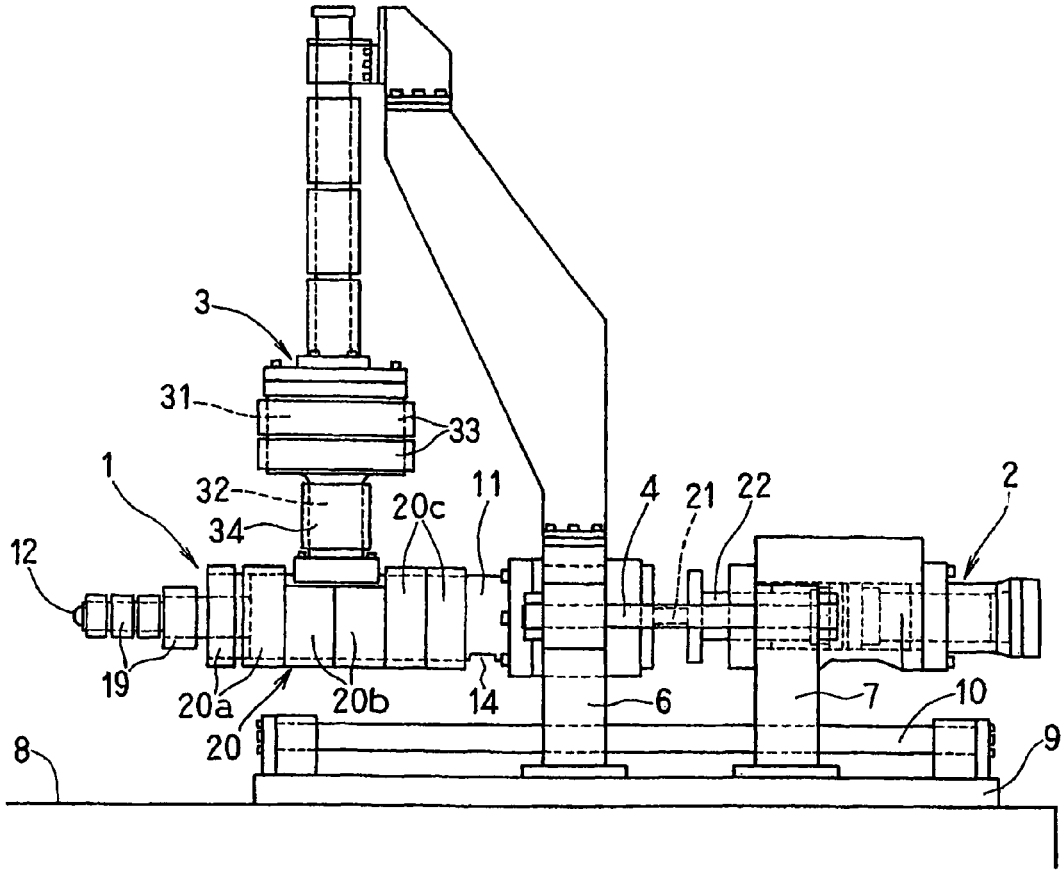
FIG. 1 is a side view of an injection apparatus of a metal molding apparatus to which a method for controlling leak according to the present invention is applicable.

In FIG. 1, reference numeral 1 denotes an injection cylinder of a metal molding apparatus of injection type; 2, an injection drive apparatus provided at and separated from a rear end of the injection cylinder 1; and 3, a material melting and supplying apparatus provided above the injection cylinder 1. The injection cylinder 1 and the injection drive apparatus 2 are connected with each other by rods 4 respectively provided on the both sides, and both of them are horizontally provided on a machine base 8 by inserting front and rear supports 6 and 7 integrally formed with each cylinder and the injection drive apparatus 2 respectively into a pair of parallel left and right support shafts 10 provided horizontally on a seat plate 9 of the machine base 8.

Figure 2:
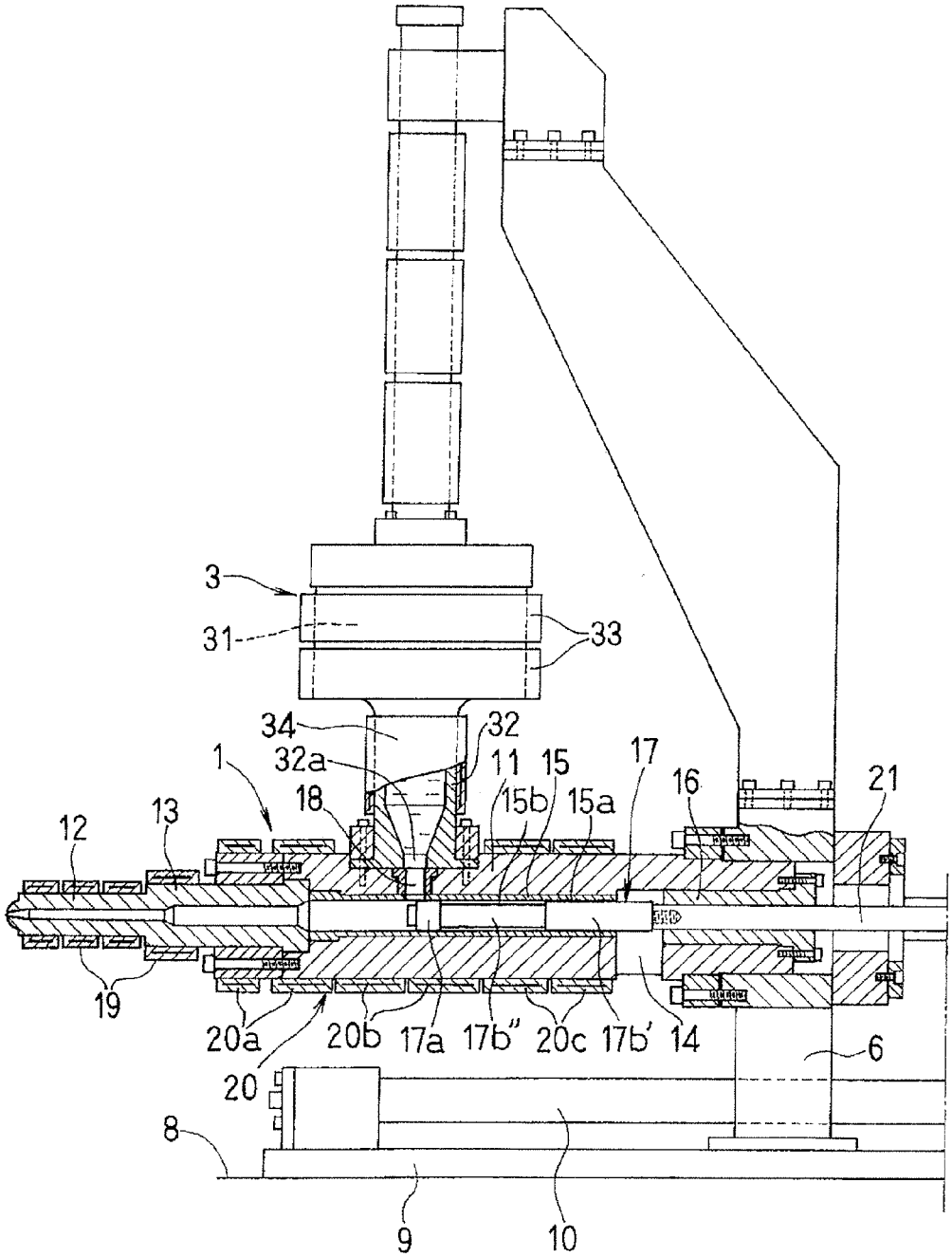
FIG. 2 is a longitudinal side cross sectional view of the injection apparatus of FIG. 1.

The injection cylinder 1 includes a cylinder body 11, a nozzle member 13 attached to a front end of the cylinder body 11 integrally with a nozzle 12, a discharge opening 14 bored on a bottom side of a cylinder wall at a rear portion of the cylinder body 11, a cylinder liner 15 that is structured and arranged to fit inside the cylinder body 11 while a rear end thereof is at the discharge opening 14, a cylinder bush 16 that is structured and arranged to fit inside a rear end portion of the cylinder body 11 while a front end thereof is at the discharge opening 14, an injection plunger 17 inserted into the cylinder liner 15 for moving forward and backward in the cylinder body 11, a supply opening 18 provided on a top side of the cylinder wall more forward than a most backward position of a plunger head 17*a*, heating means 19 attached to an outer periphery of the nozzle 12 and the nozzle member 13, and heating means 20 attached to an outer periphery of the cylinder body 11 as shown in FIG. 2

A clearance with desired dimensions for communicating a molten metal material is set on a periphery of the plunger head 17*a* of the injection plunger 17. Moreover, the outer diameter of a plunger rod rear portion 17*b*' is smaller than the inner diameter of the cylinder liner 15 by a slide clearance 15*a* (such as 0.05 mm to 0.30 mm) for reducing a friction resistance. Moreover, the outer diameter of a plunger rod front portion 17*b*" is smaller than the plunge rod rear portion 17*b*' from the front end to a position of the supply opening 18 when the injection plunger 17 is at a most forward position. As a result, a communication gap 15*b*, which is always in communication with the supply opening 18, is formed around the plunger rod front portion 17*b*".

An iron base metal material is employed for the cylinder body 11, while a metal material of the same quality of a cobalt base alloy or a cermet base alloy is employed for both the cylinder liner 15 and the injection plunger 17. The thermal expansion due to a temperature increase is always the same in the cylinder liner 15 and the injection plunger 17 made of the base alloy of the same quality, the dimensions of the slide clearance 15*a* and the communication gap 15*b* formed therebetween do not change and maintain constant dimensions set at a normal temperature.

An injection rod 21 smaller in diameter than the plunger rod rear portion 17*b*' is inserted in the cylinder bush 16, a front end of the injection rod 21 is coupled to the plunger rod rear portion 17*b*', and the rear end is coupled to the piston rod 22 of the injection drive apparatus 2 as shown in FIG. 1.

Figure 4:
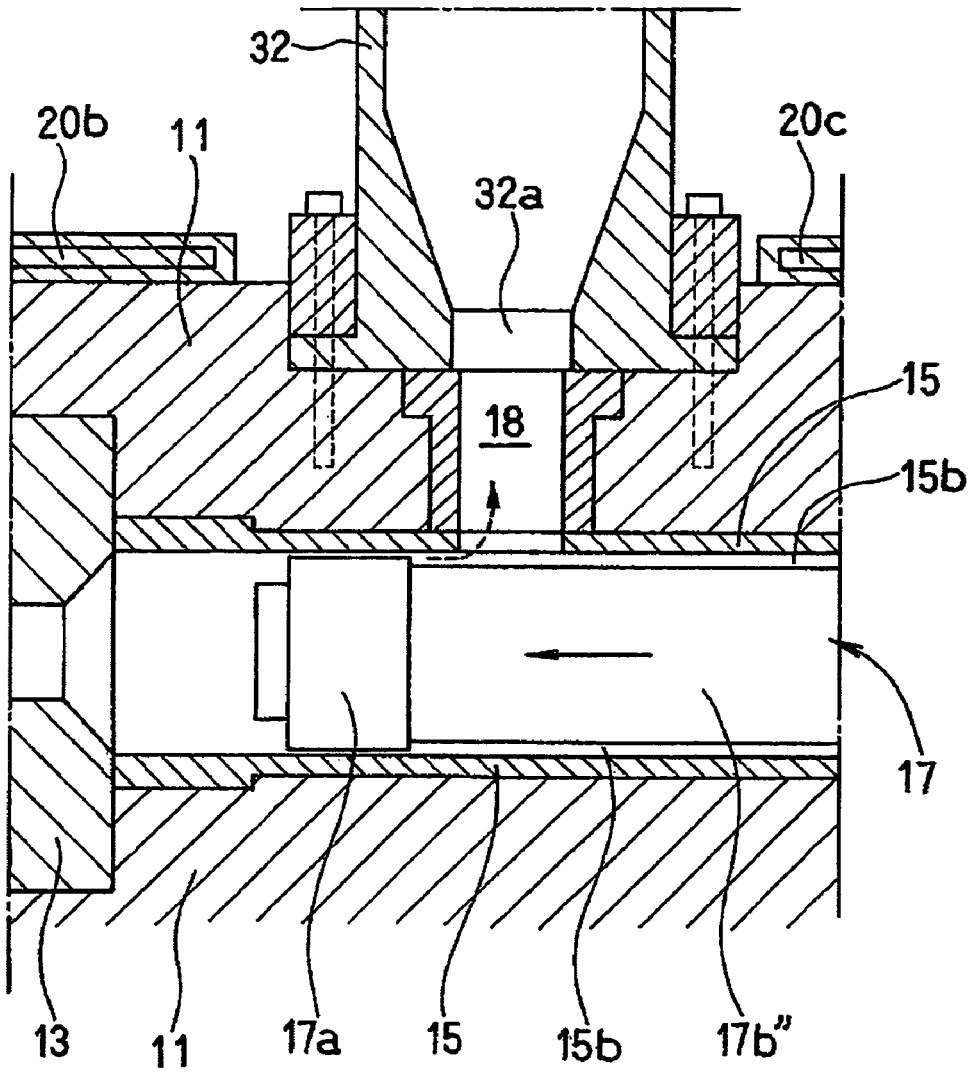
FIG. 4 is a partial cross sectional view of the cylinder body at a material supply portion during an injection operation.

The material melting and supplying apparatus 3 includes a furnace body 31 having a circular shape as its plane surface, and a reserve cylinder 32 formed by downward extending a center of a bottom surface of the furnace body 31 as an integral body portion, and sequentially reducing a bottom portion inner wall down to the flow outlet 32*a* at a center at the bottom end so the bottom portion inner wall is formed as an inclined surface, the flow outlet 32*a* is caused to coincide with the supply opening 18 so as to be placed above the cylinder body, and the communication gap 15*b* inside the cylinder body and the inside of the material melting and supplying apparatus 3 always communicate with each other via the supply opening 18 and the flow outlet 32*a* as shown in FIG. 4. Moreover, heating means 33, 34 are attached to outer peripheries of the furnace body 31 and the reserve cylinder 32. The furnace body 31 and the reserve cylinder 32 are heated to and maintained at a temperature equal to or higher than the liquidus temperature, or lower than the liquidus temperature but equal to or higher than the solidus temperature by these heating means 33, 34.

The heating means 20 is provided in a portion between the front end and the discharge opening 14 of the cylinder body 11 as front portion heating means 20*a*, middle portion heating means 20*b*, and rear portion heating means 20*c*, which respectively include a pair of front and rear band heaters, and this configuration allows temperature control for the cylinder body 11 in respective three zones: a front portion, a middle portion, and a rear portion.

Figure 3:
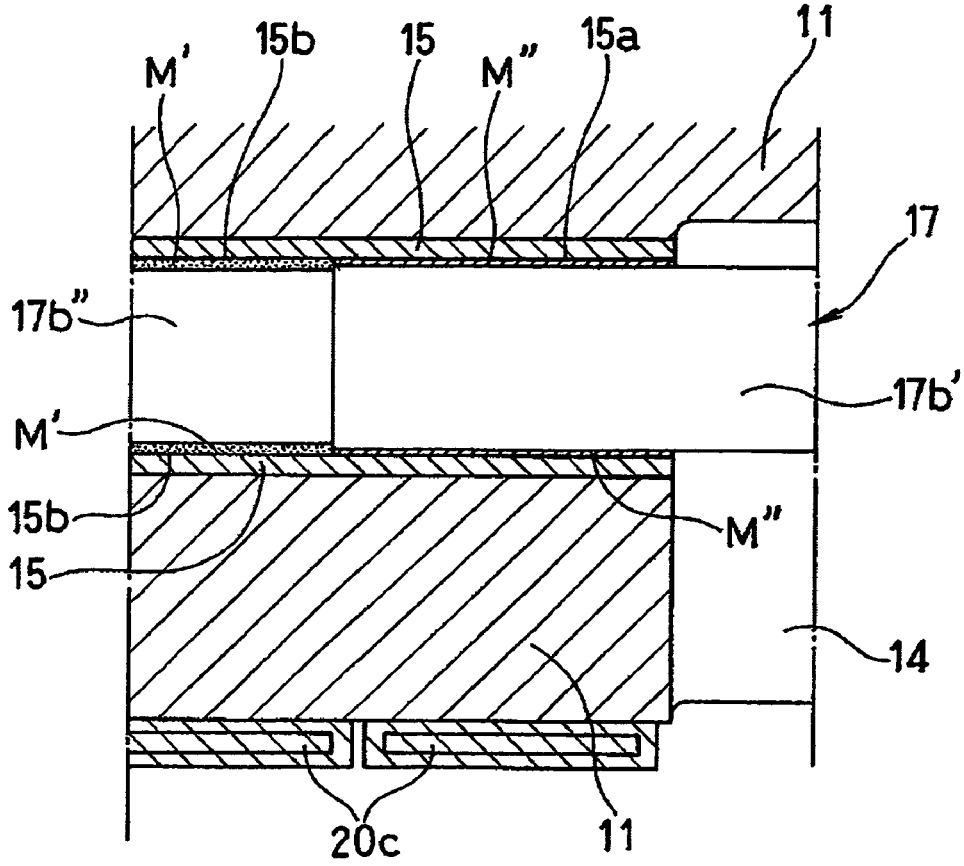
FIG. 3 is a partial cross sectional view of a cylinder body at a discharge opening portion.

The front portion heating means 20*a* and the middle portion heating means 20*b* are set to a temperature which maintains the molten metal material, which is heated to the temperature equal to or higher than the liquidus temperature, or lower than the liquidus temperature but equal to or higher than the solidus temperature in the material melting and supplying device 3, and is supplied from the supply opening 18 into the cylinder body in a fully molten state (such as 620° C.) or the partially molten state (such as 580° C.), in the fully molten state or the partially molten state until injected by the injection plunger 17. Moreover, the rear portion heating means 20*c* is set to a temperature which causes a molten metal material M' in the communication gap 15*b*, which enters the slide clearance 15*a*, will not leak from a clearance end in the molten state, but will interpose as a circular seal metal M" as hard as functioning as a lubrication layer as shown in FIG. 3.

If the molten metal material in the slide clearance 15*a* is fully solidified, and is thus hardened, the metal material constitutes a slide resistance, thereby obstructing the travel of the injection plunger 17, and generating a large metal friction noise, this temperature is set in a range from the solidus temperature to the solidus temperature +20° C. in which the molten metal material does not solidify, 470 to 490° C., for example, if the metal material is a magnesium base alloy (AZ91D), for example. In this temperature range, the seal metal M" functions as a lubrication layer for the plunger rod rear portion 17*b'*.

The seal metal M" interposed in the slide clearance 15*a* restricts the molten metal material M' from leaking from the communication gap 15*b* as the injection plunger 17 travels forward. Moreover, the seal metal M" sequentially moves backward as the plunger rod 17*b*' moves by sliding, sequentially falls from the clearance end into the discharge opening 14, and is discharged outside the cylinder. The temperature of the discharged seal metal M" is equal to or lower than the solidus temperature +20° C., so even a magnesium base alloy, which tends to spontaneously ignite if it comes in contact with air at a temperature equal to or higher than 500° C., will not ignite, resulting in a safe discharge.

Moreover, even if the seal metal M" interposes in the slide clearance 15*a*, since the cylinder body 11 and the inside of the material melting and supplying apparatus 3 always communicate with each other, even if the molten metal material (not shown), which is accumulated and measured, from the clearance around the plunger head 17*a* in a cylinder front room on a front surface of the plunger head 17*a* by the backward travel of the injection plunger from the most forward position, which is not shown, is pressurized by the forward travel of the injection plunger 17, and flows back from the clearance of the cylinder head 17*a* into the communication gap 15*b*, the amount of the flow back is lead into the material melting and supplying apparatus 3, thereby preventing the pressure in the communication gap 15*b* from increasing.

Moreover, though the molten metal material in the communication gap is pressurized by a step portion of the plunger rod rear portion 17*b*' as the injection plunger 17 travels forward, the pressure in the communication gap 15*b* does not increase due to the communication with the material melting and supplying apparatus 3. Thus, the leak of the molten metal material into the slide clearance 15*a* also reduces. As a result, the leak into the slide clearance 15*a* due to the increased pressure in the communication gap 15*b* is prevented, and the leak of the molten metal material into the slide clearance 15*b* is always restricted to the discharged amount of the seal metal M", the seal metal M" interposed in an excessively concentrated state will not press the plunger rod rear portion 17*b*'. The smooth forward and backward travel of the injection plunger 17 is thus maintained even in an operation for a long period, and the injection loss of the molten metal material due to the leak is reduced.

Though the communication gap 15*b* is provided around the plunger rod front portion 17*b*" according to the above embodiment, if the slide clearance is extended in a permissible range across the entire plunger rod, the communication clearance 15*b* is omitted.

What is claimed is:

1. A method for controlling leaking of a molten metal material in an injection apparatus for molding a metal material, the injection apparatus comprising:

a melting and supplying apparatus for melting a metal material and having a flow outlet provided at a bottom end thereof to supply a molten metal;

an injection cylinder, located at a bottom portion of the melting and supplying apparatus, the injection cylinder comprising:

a cylindrical body having:

a cylinder liner, a supply opening communicating with the flow outlet, an interior space for accumulating the molten metal supplied from the flow outlet, and a nozzle located at a front end of the cylindrical body, a discharge opening on a bottom side of a rear portion of the cylindrical body, heating means on an outer periphery of the cylindrical body, and an injection plunger inserted into the interior space of the cylindrical body for forward and backward travel with a slide clearance between the injection plunger and the cylindrical body; the method comprising:

supplying molten metal material from the melting and supplying apparatus to a forward portion of the interior space of the cylindrical body by a backward travel of the injection plunger;

injecting some of the molten metal material accumulated in the forward portion of the interior space of the cylindrical body via the nozzle by a forward travel of the injection plunger; and heating a front portion, a middle portion, and a rear portion of the cylinder liner from the front end to the discharge opening of the cylindrical body, that includes:

heating the front portion and the middle portion to a temperature that maintains the temperature of the molten metal supplied from the melting and supplying apparatus and in the forward portion of the interior space of the cylindrical body, and heating the rear portion to a temperature less than the temperature in the front and middle portions;

forming a seal within a communication gap between an inner surface of the cylindrical liner and an outer surface of the injection plunger using some portion of the molten metal material from the rear portion, to minimize leakage; and lubricating the injection plunger along the inner surface of the cylindrical liner using some of the molten metal material from the rear portion.

2. The method according to claim 1, wherein the metal material includes a magnesium base alloy, and the temperature of the rear portion of the cylindrical body is set to a temperature in a range from 470° C. as a solidus temperature of the magnesium base alloy to 490° C., thus causing the molten metal supplied from the melting and supplying apparatus and then accumulated in the forward portion of the interior space of the cylindrical body leaking along the slide clearance to act as a metal seal and as a lubrication layer.

3. The method according to claim 1, wherein the metal seal in the slide clearance is sequentially discharged to the discharge opening as the injection plunger travels backward.

4. The method according to claim 1, wherein the material melting and supplying apparatus for melting the metal material is always in a communication state with the interior space of the cylindrical body via the supply opening and the flow outlet, thereby leading the molten metal, which is pressurized by the forward travel of the injection plunger, to flow back from a clearance between a head of the injection plunger, into the melting and supplying apparatus for melting the metal material, resulting in reducing the leakage of the molten metal supplied from the melting and supplying apparatus and then accumulated in the forward portion of the interior space of the cylindrical body through the slide clearance to the plunger rod rear portion of the injection plunger.

5. The method according to claim 1, wherein the inside of the cylindrical body is formed of a cylindrical liner, and the cylindrical liner and the injection plunger are made of a metal material of the same material.

6. The method according to claim 5, wherein a cylindrical body main unit is made of an iron base metal material, and the cylindrical liner and the injection plunger are made of a metal material of the same material which is a cobalt base alloy or a cermet base alloy.

7. The method according to claim 2, wherein the metal seal in the slide clearance is sequentially discharged to the discharge opening as the injection plunger travels backward.

8. The method according to claim 1 further comprising discharging the seal and lubricating material outside of the cylinder through the discharge opening disposed at the rear portion of the cylinder body.

9. The method according to claim 8, wherein the seal and lubricating material is discharged so as not to cause said seal and lubricating material to ignite.

10. The method as recited in claim 1, wherein heating the front portion and the middle portion includes heating said portions to a temperature at or substantially at a liquidus temperature of the molten metal material.

11. The method as recited in claim 1, wherein heating the rear portion includes heating said portion to a temperature at or substantially at a solidus temperature of the molten metal material.

12. The method as recited in claim 11, wherein heating the rear portion includes heating said portion to a temperature within +20° C. (+60° F.) of the solidus temperature of the molten metal material.

* * * * *